US009272840B2

(12) United States Patent
Hobson et al.

(10) Patent No.: US 9,272,840 B2
(45) **Date of Patent: *Mar. 1, 2016**

(54) DISPOSABLE PROCESSING BAG WITH ALIGNMENT FEATURE

(71) Applicant: EMD Millipore Corporation, Billerica, MA (US)

(72) Inventors: James Hobson, Burleson, TX (US); James Austin, Forth Worth, TX (US); Boris Pesakovich, Brookline, MA (US); Elias G. Noukas, Burlington, MA (US); Thomas Janko, Stoneham, MA (US); Shaun McMahon, Dublin, NH (US)

(73) Assignee: EMD Millipore Corporation, Billerica, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/745,770

(22) Filed: Jun. 22, 2015

(65) Prior Publication Data

US 2015/0291349 A1 Oct. 15, 2015

Related U.S. Application Data

(62) Division of application No. 12/079,233, filed on Mar. 25, 2008, now Pat. No. 9,090,398.

(60) Provisional application No. 60/927,598, filed on May 4, 2007.

(51) Int. Cl.
*B65D 33/00* (2006.01)
*B65D 88/20* (2006.01)
(Continued)

(52) U.S. Cl.
CPC . *B65D 88/20* (2013.01); *A61J 1/10* (2013.01); *B65F 1/06* (2013.01); *B65B 69/0091* (2013.01);
(Continued)

(58) Field of Classification Search
CPC ..... B65D 77/061; B01F 15/0085
USPC ..... 383/33
See application file for complete search history.

(56) References Cited

U.S. PATENT DOCUMENTS 3,372,725 A 3/1968 Voorhees
3,552,577 A 1/1971 Latham
(Continued)

FOREIGN PATENT DOCUMENTS

DE 29923221 U1 8/2000
EP 0825134 A1 2/1998
(Continued)

OTHER PUBLICATIONS

"Asymmetric", Available at: http://www.thefreedictionary.com/asymmetric, Retrieved on Mar. 4, 2014, 2 pages.
(Continued)

*Primary Examiner* — Jes F Pascua
*Assistant Examiner* — Derek Battisti
(74) *Attorney, Agent, or Firm* — EMD Millipore Corporation

(57) ABSTRACT

The present invention is an alignment device for a bag containing one or more ports. The alignment device is attached to either the one or more ports or to the bag adjacent the one or more ports. The plate has an indicator or a unique outer edge shape that is designed to fit into a corresponding unique opening in a holder to ensure proper alignment of the bag and its port(s) in the holder. The plate is has a series of holes equal to and in alignment with the one or more ports of the bag and the port(s) extend through the holes of the plate.

14 Claims, 7 Drawing Sheets

(51) Int. Cl.

| | |
|---|---|
| ***B65F 1/06*** | (2006.01) |
| ***A61J 1/10*** | (2006.01) |
| *B65B 69/00* | (2006.01) |
| *B65D 90/04* | (2006.01) |

(52) U.S. Cl.

CPC ..... *B65D 90/046* (2013.01); *B65D 2203/10* (2013.01); *B65D 2303/00* (2013.01); *Y10T 29/49826* (2015.01)

(56) References Cited

U.S. PATENT DOCUMENTS

| | | | | |
|---|---|---|---|---|
| 3,623,629 | A | 11/1971 | Hendershot | |
| 3,648,690 | A | 3/1972 | Miller et al. | |
| 3,783,920 | A | 1/1974 | Weikert | |
| 3,876,119 | A | 4/1975 | Lamkin | |
| 3,931,834 | A | 1/1976 | Caillet | |
| 4,013,558 | A | 3/1977 | Rosenberg | |
| 4,226,280 | A | 10/1980 | Hellouin De Cenival et al. | |
| 4,258,723 | A | 3/1981 | Mccue et al. | |
| 4,344,264 | A | 8/1982 | Smith | |
| 4,397,406 | A | 8/1983 | Croley | |
| 4,439,179 | A | 3/1984 | Lueders et al. | |
| 4,461,402 | A | 7/1984 | Fell et al. | |
| 4,516,692 | A | 5/1985 | Croley | |
| 4,536,901 | A | 8/1985 | Jones et al. | |
| 4,595,037 | A | 6/1986 | Lebreton et al. | |
| 4,754,786 | A | 7/1988 | Roberts | |
| 4,847,028 | A | 7/1989 | Snyder et al. | |
| 4,850,506 | A | 7/1989 | Heaps et al. | |
| 4,896,789 | A | 1/1990 | Federspiel | |
| 5,064,096 | A | 11/1991 | Illing et al. | |
| 5,145,499 | A | 9/1992 | Dyson | |
| 5,145,735 | A | 9/1992 | Deller et al. | |
| 5,156,295 | A | 10/1992 | Gordon et al. | |
| 5,190,720 | A | 3/1993 | Hunsbedt et al. | |
| 5,265,753 | A | 11/1993 | Moorman | |
| 5,322,195 | A * | 6/1994 | Ellis | B65D 90/205 222/105 |
| 5,350,080 | A | 9/1994 | Brown et al. | |
| 5,362,642 | A | 11/1994 | Kern | |
| 5,368,073 | A | 11/1994 | Murphy | |
| 5,375,733 | A | 12/1994 | Kohler et al. | |
| 5,402,915 | A * | 4/1995 | Hogan | B65D 77/0466 222/105 |
| 5,427,267 | A * | 6/1995 | Willman | B65D 77/02 229/117.34 |
| 5,465,436 | A | 11/1995 | Bleicher | |
| 5,484,079 | A | 1/1996 | Carter et al. | |
| 5,497,912 | A | 3/1996 | Hoback et al. | |
| 5,505,327 | A | 4/1996 | Witt | |
| 5,531,360 | A * | 7/1996 | Berdel | B65B 69/0091 206/386 |
| 5,564,829 | A | 10/1996 | Lafond | |
| 5,673,818 | A | 10/1997 | Kaneski et al. | |
| 5,687,993 | A | 11/1997 | Brim | |
| 5,799,830 | A | 9/1998 | Carroll et al. | |
| 5,803,888 | A | 9/1998 | Severs et al. | |
| 5,810,202 | A * | 9/1998 | Hoback | A61M 5/1486 222/209 |
| 5,816,431 | A | 10/1998 | Giannopoulos | |
| 5,836,363 | A | 11/1998 | Lafleur | |
| 5,941,635 | A | 8/1999 | Stewart | |
| 5,944,251 | A | 8/1999 | LaFleur | |
| 6,032,818 | A | 3/2000 | Olson | |
| 6,071,005 | A | 6/2000 | Ekambaram et al. | |
| 6,076,457 | A | 6/2000 | Vallot | |
| 6,086,574 | A | 7/2000 | Carroll et al. | |
| 6,186,932 | B1 | 2/2001 | Vallot | |
| 6,190,913 | B1 | 2/2001 | Singh | |
| 6,273,332 | B1 | 8/2001 | Todjar-Hengami | |
| 6,286,700 | B1 | 9/2001 | Davidson | |
| 6,299,437 | B1 | 10/2001 | Bonerb et al. | |
| D452,135 | S | 12/2001 | Wyatt et al. | |
| 6,347,886 | B1 | 2/2002 | Willemstyn | |
| 6,398,053 | B1 | 6/2002 | Thornsen | |
| 6,450,215 | B1 | 9/2002 | Willemstyn et al. | |
| 6,481,598 | B1 | 11/2002 | Thornsen | |
| 6,505,524 | B1 | 1/2003 | Silvis | |
| 6,682,108 | B1 | 1/2004 | Arch | |
| 6,758,593 | B1 | 7/2004 | Terentiev | |
| 6,773,385 | B2 | 8/2004 | Johnson et al. | |
| 6,844,186 | B2 | 1/2005 | Carll | |
| 6,942,123 | B2 | 9/2005 | Wertenberger | |
| 6,955,701 | B2 | 10/2005 | Schrage | |
| 6,981,794 | B2 | 1/2006 | Bibbo et al. | |
| 6,988,639 | B2 | 1/2006 | Arch | |
| 7,004,196 | B2 | 2/2006 | Schubmehl et al. | |
| 7,073,670 | B2 | 7/2006 | Fall et al. | |
| 7,077,559 | B2 | 7/2006 | Hlavinka et al. | |
| 7,086,778 | B2 | 8/2006 | Terentiev | |
| 7,087,160 | B2 | 8/2006 | Beer et al. | |
| 7,117,653 | B2 | 10/2006 | Yakushigawa et al. | |
| 7,140,516 | B2 | 11/2006 | Bothor et al. | |
| 7,153,021 | B2 | 12/2006 | Goodwin et al. | |
| 7,476,265 | B2 * | 1/2009 | Firman | B65G 69/182 222/105 |
| 7,528,712 | B2 | 5/2009 | Hong et al. | |
| 7,644,902 | B1 | 1/2010 | Julian et al. | |
| 7,658,286 | B2 * | 2/2010 | Murray | B65B 43/04 206/459.1 |
| 7,740,212 | B2 * | 6/2010 | Austin | A61G 7/0503 248/65 |
| 2003/0011194 | A1 | 1/2003 | Arch | |
| 2003/0077466 | A1 | 4/2003 | Smith et al. | |
| 2003/0166442 | A1 | 9/2003 | Johnson et al. | |
| 2004/0027912 | A1 | 2/2004 | Bibbo et al. | |
| 2004/0074922 | A1 | 4/2004 | Bothor et al. | |
| 2004/0261889 | A1 | 12/2004 | Elgan et al. | |
| 2005/0040063 | A1 | 2/2005 | Churvis et al. | |
| 2005/0063247 | A1 | 3/2005 | Krause | |
| 2005/0063250 | A1 | 3/2005 | Hubbard | |
| 2005/0158615 | A1 | 7/2005 | Samuel et al. | |
| 2005/0163667 | A1 | 7/2005 | Krause | |
| 2005/0178768 | A1 | 8/2005 | Woollen | |
| 2005/0218075 | A1 | 10/2005 | Graetz et al. | |
| 2005/0249033 | A1 | 11/2005 | Krause | |
| 2005/0272146 | A1 | 12/2005 | Hodge et al. | |
| 2005/0281132 | A1 | 12/2005 | Armstrong et al. | |
| 2006/0028909 | A1 | 2/2006 | Behague | |
| 2006/0061009 | A1 | 3/2006 | Clack | |
| 2006/0065310 | A1 | 3/2006 | West et al. | |
| 2006/0086741 | A1 | 4/2006 | Bacon et al. | |
| 2006/0114744 | A1 | 6/2006 | White et al. | |
| 2006/0176772 | A1 | 8/2006 | Goodwin et al. | |
| 2006/0196501 | A1 | 9/2006 | Bibbo et al. | |
| 2006/0270036 | A1 | 11/2006 | Goodwin et al. | |
| 2006/0280028 | A1 | 12/2006 | West et al. | |
| 2007/0064519 | A1 | 3/2007 | Neumann | |
| 2008/0006636 | A1 | 1/2008 | Wild et al. | |
| 2008/0310768 | A1 | 12/2008 | Hobson et al. | |
| 2009/0188211 | A1 * | 7/2009 | Galliher | B01F 13/0827 53/434 |
| 2011/0041952 | A1 * | 2/2011 | Gaultney | B01F 13/1005 141/83 |

FOREIGN PATENT DOCUMENTS

| | | | |
|---|---|---|---|
| EP | 1101712 | A1 | 5/2001 |
| EP | 1127806 | A1 | 8/2001 |
| EP | 1739165 | A1 | 1/2007 |
| GB | 1300629 | A | 12/1972 |
| GB | 1511729 | A | 5/1978 |
| GB | 2121361 | A | 12/1983 |
| GB | 2315483 | A | 2/1998 |
| JP | 56-19157 | U | 2/1981 |
| JP | 60-7273 | A | 1/1985 |
| JP | 63129546 | U | 8/1988 |
| JP | 2006-321523 | A | 11/2006 |
| WO | 91/06490 | A1 | 5/1991 |
| WO | 94/15864 | A1 | 7/1994 |
| WO | 94/25252 | A1 | 11/1994 |
| WO | 95/01925 | A1 | 1/1995 |
| WO | 97/39824 | A1 | 10/1997 |

(56) References Cited

FOREIGN PATENT DOCUMENTS

| | | | |
|---|---|---|---|
| WO | 02/31372 | A1 | 4/2002 |
| WO | 02/41484 | A2 | 5/2002 |
| WO | 03/018170 | A1 | 3/2003 |
| WO | 03/090795 | A1 | 11/2003 |
| WO | 2004/087320 | A2 | 10/2004 |
| WO | 2005/118771 | A2 | 12/2005 |
| WO | 2006/002091 | A2 | 1/2006 |
| WO | 2006/041541 | A1 | 4/2006 |
| WO | 2006/116139 | A2 | 11/2006 |
| WO | 2007/001173 | A2 | 1/2007 |

OTHER PUBLICATIONS

"Parallel", Available at: http://www.thefreedictionary.com/parallel, Retrieved on Mar. 4, 2014, 5 pages.

"Parallelogram", Available at: http://www.thefreedictionary.com/parallelogram, Retrieved on Mar. 4, 2014, 2 pages.

"Rhomboid", Available at: http://www.thefreedictionary.com/rhomboid, Retrieved on Mar. 4, 2014, 2 pages.

Extended European Search Report received for EP Patent Application No. 08155091.5, mailed on Sep. 18, 2008, 6 pages.

* cited by examiner

DISPOSABLE PROCESSING BAG WITH ALIGNMENT FEATURE

CROSS-REFERENCE RELATED APPLICATIONS

This application is Divisional Application of U.S. patent application Ser. No. 12/079,233, filed on Mar. 25, 25, 2008, which claims the benefit of U.S. Provisional Patent Application No. 60/927,598, filed on May 4, 2007, the entire contents of which are incorporated by reference herein.

The present invention relates to a bag for use in a holder, such as a vat or carboy, and arranging the bag in a proper alignment within the holder via an alignment feature attached to the bag. More particularly, it relates to a disposable bag for use in a holder, such as a vat or carboy, with the bag having one or ports and an alignment feature attached to the bag adjacent the one or more ports to properly orient the bag in its holder.

BACKGROUND OF THE INVENTION

Traditionally, products such as pharmaceuticals, biopharmaceuticals, enzymes, nutriceuticals and the like were processed in stainless steel containers. After use the steel containers had to be cleaned and sterilized. This often required the use of steam and/are caustics to accomplish this task.

Additionally, for regulated products such as pharmaceuticals, the sterilization process had to be validated to show that it could sterilize the device and could so time after time.

Both the cleaning process and the validation are time consuming and expensive and can't be varied without a new validation.

This has led to the use of single use, disposable plastic bags to store and process many of these products. These bags are provided sterile (generally gamma irradiated), do not require cleaning as they are disposed of after use and reduces the validation required by the user and/or shifts the validation to the bag supplier.

These bags contain one or more ports through which liquids, additives, product and the like are added or removed from the bag during processing.

These bags are generally placed into a holder such as steel plastic, fiberglass, graphite or other composite vat, tote or carboy to help hold the weight or the liquid and to protect the bag from rupture due to contact with other items on the manufacturing floor. These holders have an opening in their bottom portion through which the ports extend. As the port arrangements differ by bag type, manufacturer or customer requirement, the bottom of the holders generally have large rectangular or circular opening and a matching plate that has several openings in it through which the ports are arranged while supporting the bag bottom by the remainder of the plate.

The ports are generally unmarked and indistinguishable from each other. However their arrangement is critical to the use of the bag due the arrangement of inlets and outlets from the holder. Often, the bag is inserted wrongly (backward for example) and is only discovered when the bag is at least partially filled. This requires the removal of the liquid and either rearrangement of the bag in the holder so that the ports are properly aligned or the use of a new bag.

What is needed is a better means for properly arranging a bag in its holder.

SUMMARY OF THE INVENTION

The present invention is an alignment device for a bag containing one or more ports wherein the alignment device is attached to either the one or more ports such as by wire ties, clamps or cable ties or to the bag adjacent the one or more ports via adhesives or welding or molding such as overmolding. The plate has either an indicator or an unique outer edge shape that is designed to fit into a corresponding unique opening in a bag holder such as a carboy or tote to ensure proper alignment of the bag and its port(s) in the holder.

In one embodiment the plate formed of plastic has a series of holes equal to and in alignment with the one or more ports of the bag and the port(s) are extended through the holes of the plate and the plate is attached to the bag by retainers on the port(s) below the plate. Such retainers can be plastic cable ties, wire ties, tube clamps and the like.

Alternatively, the plate may be fitted over the port(s) and attached to the bag such as by thermal bonding or welding.

In another embodiment, the plate is overmolded to the bag or the bag is formed and molded to the plate.

The plate may have any unique design that ensures that the alignment of the bag in the holder is correct and cannot be reversed or incorrectly aligned. Such designs use a plate that is affixed to the bag or its port(s) in such a way that it cannot be realigned or moved out of register.

Such designs include but are not limited to plates having a permanent graphical representation as to the alignment or an asymmetrical design which corresponds to a similar opening in the holder.

In another embodiment, the plate has two parts, an inner asymmetric portion and symmetric outer portion selectively attachable to the inner asymmetric plate portion and is of a configuration to fit into a standard opening in a holder.

DETAILED DESCRIPTION OF THE INVENTION

Figure 1:
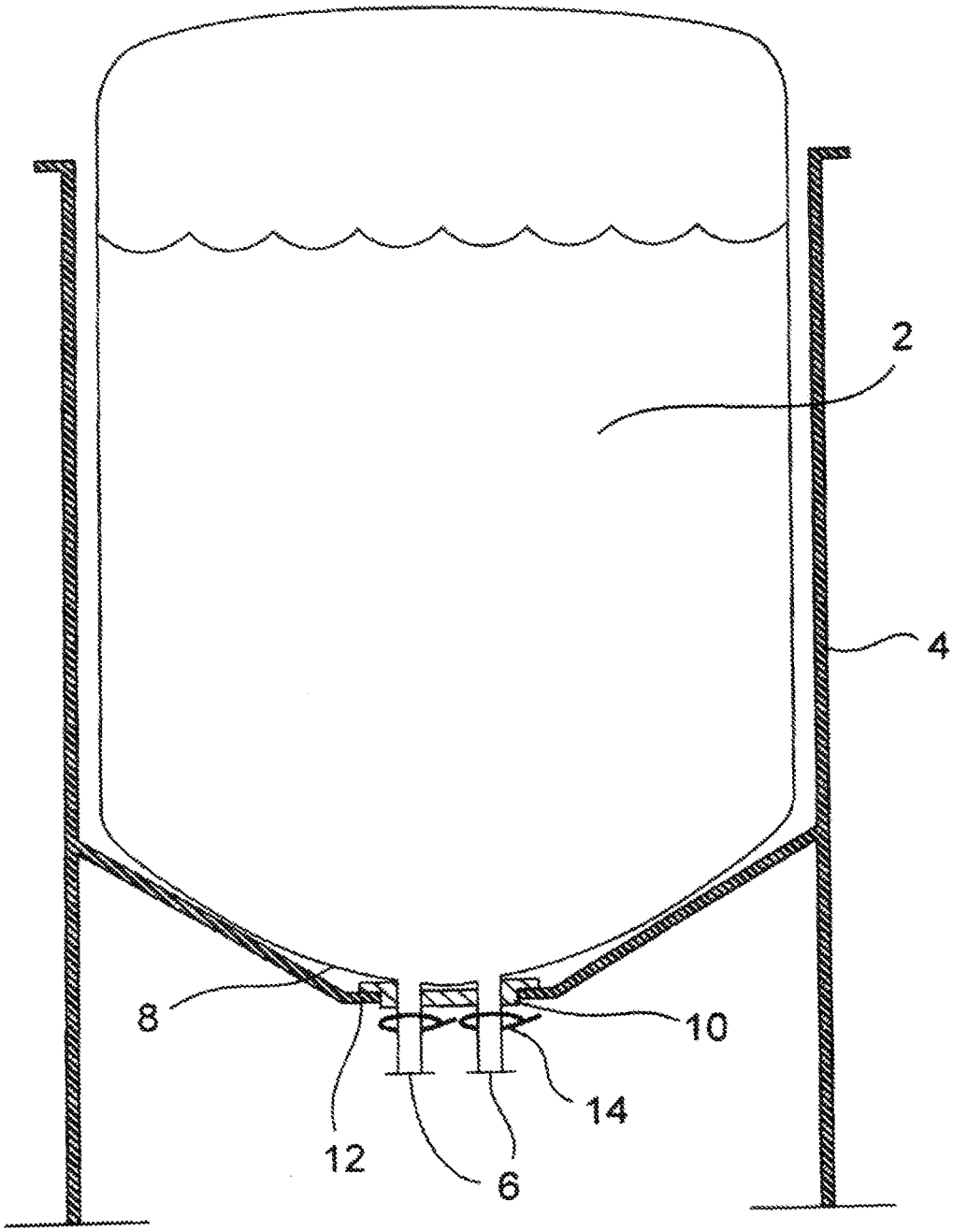
FIG. 1 shows a first embodiment of the present invention in cross-sectional view.

In FIG. 1 is shown a first embodiment of the present invention in cross-sectional view. A bag 2 is held within a holder 4 such as a carboy or a tote and has one or more ports 6 extending out at least of its lowermost portion 8. An alignment plate 10 is attached to either the bag 2 or its one or more ports 6 as will be discussed below. The plate 10 also provides support for the bottom of the bag while in use in the holder 4 by fitting into and aligning with a hole or opening 12 in the lowermost portion 8 of the holder 4. As can be seen, the port(s) 6 extend through the plate 10 so they may be connected to inlets, outlets, pumps, storage bags, tubing, etc (not shown) as is needed in the process. In this embodiment the plate 10 is attached to the ports 6 of the bag 2 by an attachment device 14 such as a cable tie or a wire wrap or similar device.

To the extent the same elements are used in later Figures, their reference numbers remain the same.

Figure 2:
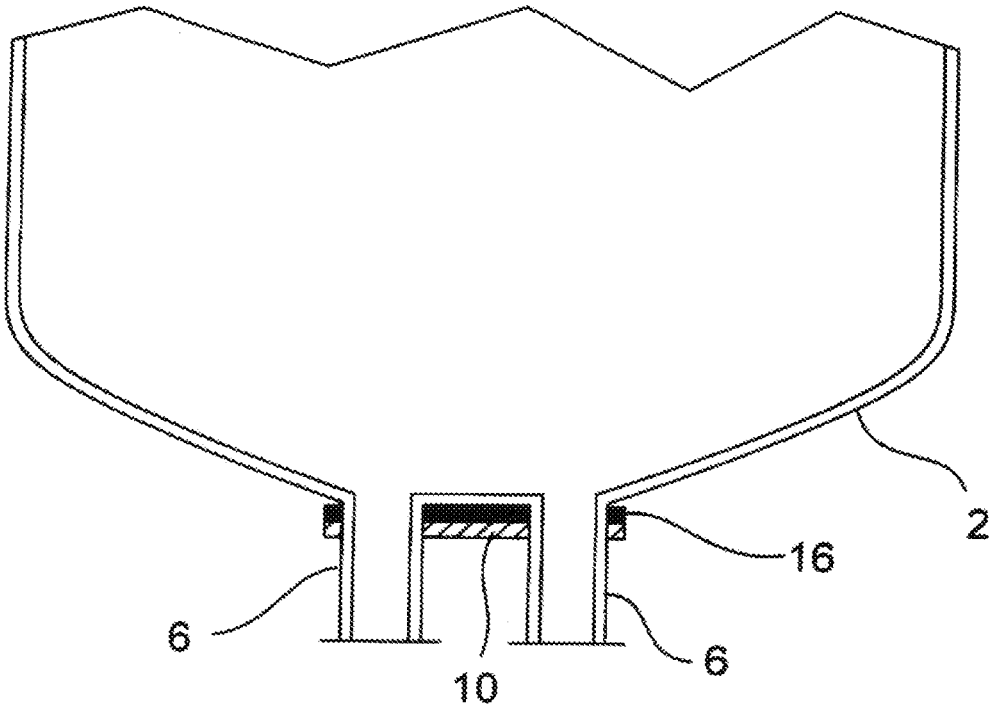
FIG. 2 shows a second embodiment of the present invention in planar, bottom view.

As shown in FIG. 2, one surface 16 of the plate 10 may be adhered or welded or molded to the bag 2 during assembly so that its orientation remains the same.

Figure 3:
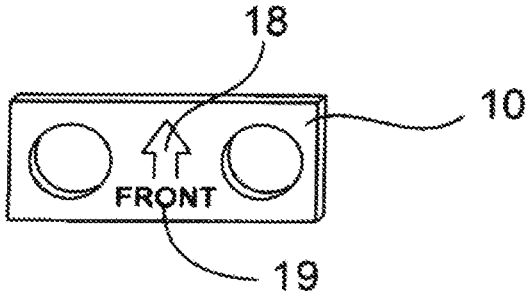
FIG. 3 shows a third embodiment of the present invention in cross-sectional view.

As shown in FIG. 3 is an embodiment of the plate containing a graphic design 18 as to the orientation or alignment of the bag 2 when it is inserted into the holder 4 such that the operator will know which way to orient the bag 2 as it is being inserted into the holder 4 and attached to the various other elements such as pumps, filters, inlet hoses, outlet hoses, etc, (not shown). The graphical design 18 may be anything such as an arrow as shown pointing in a given direction to indicate the bag's alignment to the holder 4. It may also include words 19 providing an indication of the direction of the bag or which port is which such as inlet, outlet, etc so an operator may properly align the bag in the holder. Alternatively, the graphic design 18 could be a hash mark, the arrow mentioned above or other symbol that is designed to align with a similar feature on the holder 4 itself (not shown).

Figure 4:
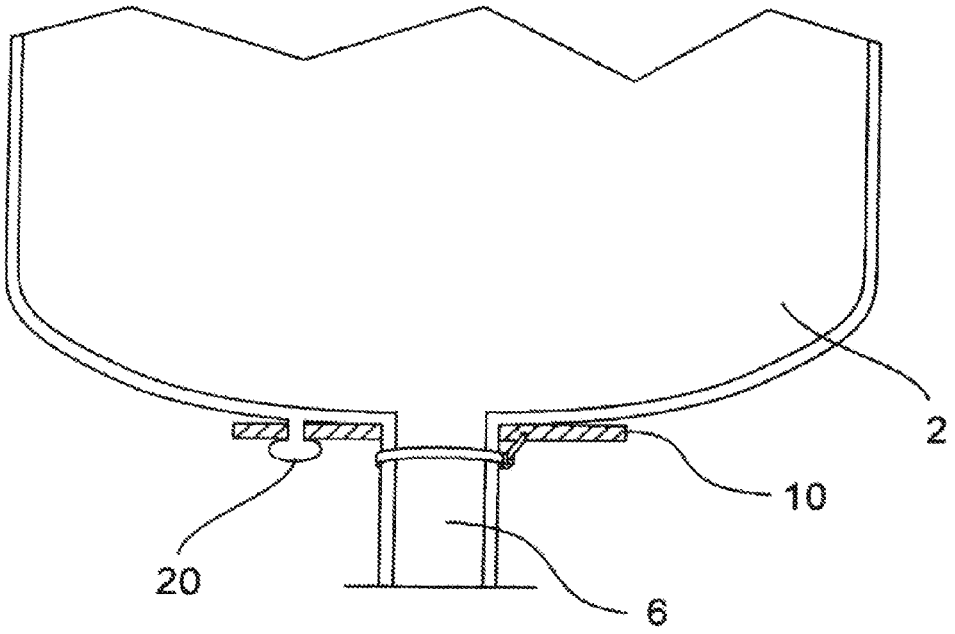
FIG. 4 shows a fourth embodiment of the present invention in cross-sectional view.

As shown in FIG. 4 is an embodiment in which the bag 2 has one port 6. In this embodiment the bag 2 also has an alignment device 20 in this case in the form of a nub that extends outwardly from the bag 2 and the alignment plate 10 contains both an opening for the port 6 but also for the alignment device 20 such that the plate 10 is always properly aligned to the bag and not allowed to rotate relative to it. The plate 10 may be attached to the port 6 in this instance by an attachment device 14 again in this instance a ratcheted cable tie. Other alignment devices include but are not limited to twist ties such as plastic coated wire ties, steel or plastic clamps and the like.

Bags 2 containing two or more ports 6 that extend through the plate 10 do not necessarily need a separate alignment device 20 but may have one if desired.

While the plate 10 in the above embodiments is shown as being a rectangle, the shape of the plate 10 and its corresponding hole 12 is not limited to such. It may be any symmetric or asymmetric shape or design that is desired, such as any polygon including but not limited to triangles, squares, pentagons, hexagons, heptagons, octagons and the like. They may also be circular or ova s. They may also be combinations of the different shapes such as two circles of different sizes or two polygons of different sizes or different shapes.

Multiple plates 10 may also be used, with each one associated either with at least one port 6 or an alignment device 20.

Any of the embodiments discussed above may if desired contain the graphical design 18 discussed above.

Figure 5A:
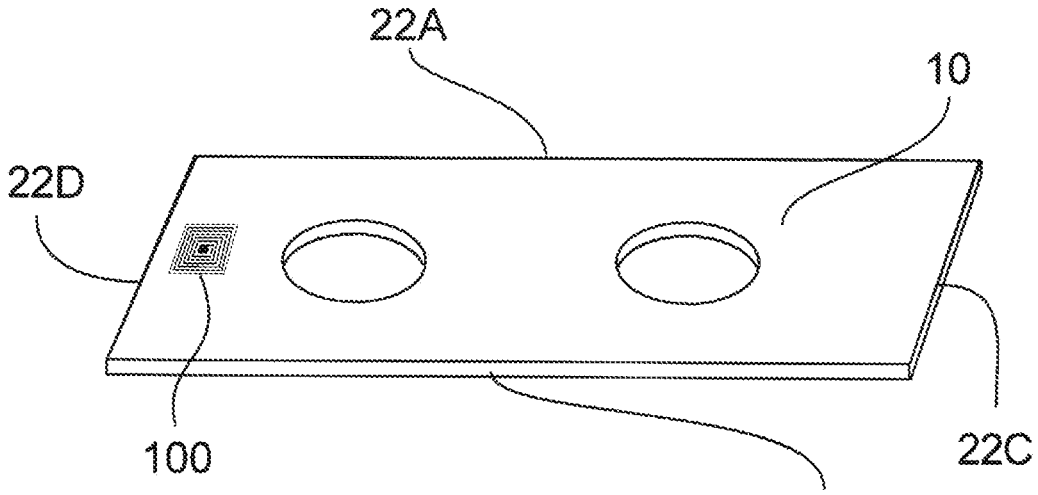
FIGS. 5 A and B shows fifth embodiment of the present invention in planar view.
Figure 5B:
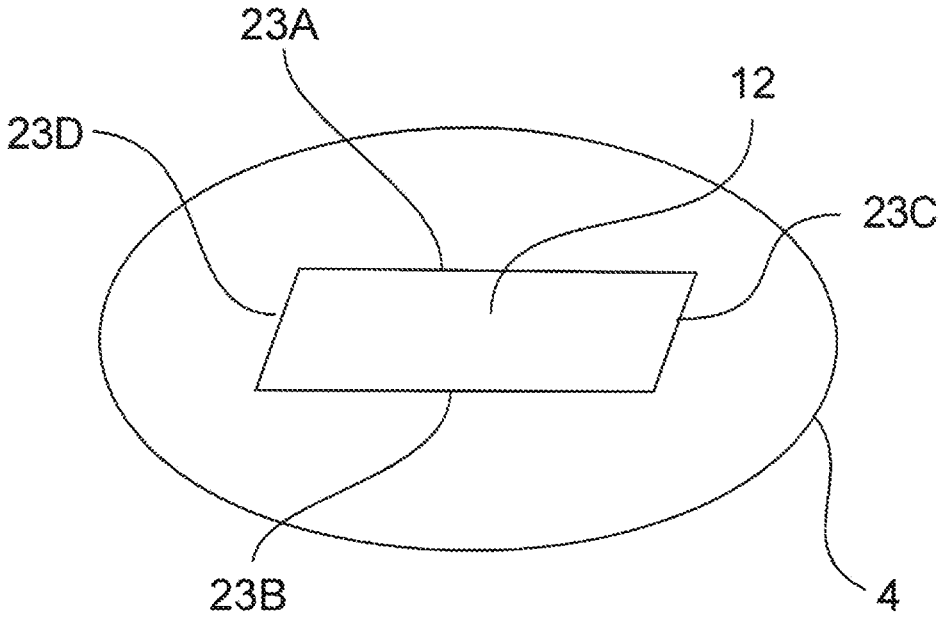

In FIG. 5A is shown a plate 10 the design of which is asymmetrical in shape and which corresponds to and sized to fit an asymmetrical opening 12 in the holder 4 as shown in FIG. 5B. In this instance, the plate 10 and opening 12 are in the shape of a four sided polygon having opposite first and second sides 22 A, B parallel to each other and a third and fourth sides 22 C,D parallel to each other and intersecting the first and second sides 22 A, B at an angle of greater than 0 degree and less than 180 degree. In this way once the plate 10 is secured to the bag 2 such that it can not rotate either by attaching the plate 10 to the bag 2 itself or through the use of various multiple ports or the use of an alignment device 16 as discussed above, the bag 2 will only fit into the opening 12 in one orientation. As can be seen the opening 12 has corresponding sides 23 A and B and 23 C and D to those respectively of sides 22A and B and 22 C and D.

Figure 6A:
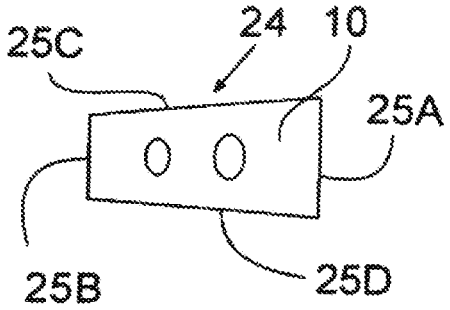
FIGS. 6 A-H show different shapes useful in the embodiments of the present invention in planar view.
Figure 6B:
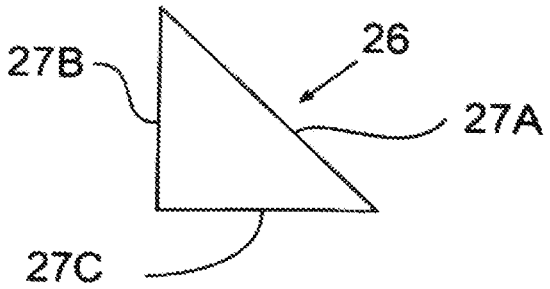
Figure 6C:
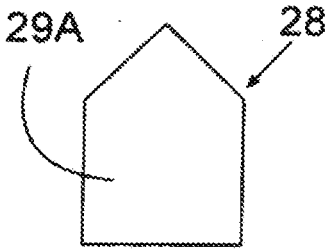
Figure 6D:
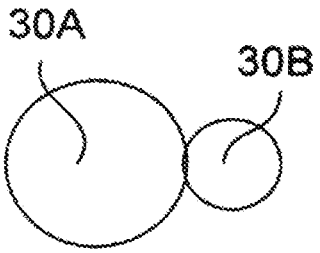
Figure 6E:
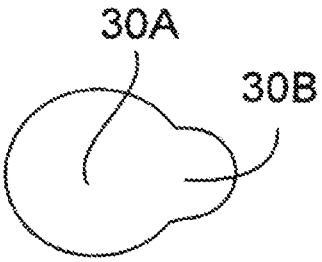
Figure 6F:
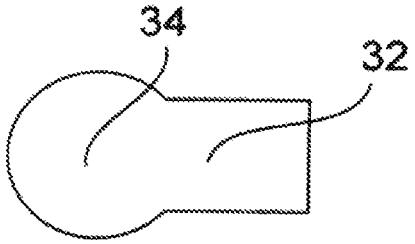
Figure 6G:
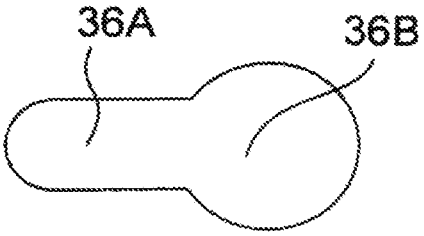
Figure 6H:
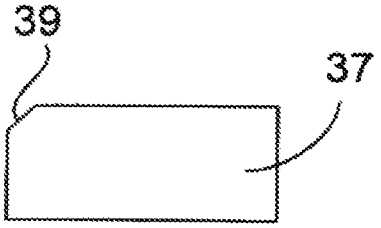

In FIGS. 6A-H are shown just a representative sampling of the possible asymmetrical plate 10 and corresponding opening 12 designs that can be used. Others will be well known and obvious to one of ordinary skill in the art and are meant to be included in the appended claims. FIG. 6A shows a polygon 24 having opposite first and second sides 25 A, B which are parallel to each other and a third and fourth sides 25 C,D which are not parallel to each other and each of which intersect the first and second sides 25 A, B at an angle of greater than 0 degree and less than 180 degree. FIG. 6B shows a triangle 26 with at least one side 27A longer than the others 27 B,C. Essentially any triangle other than an isosceles triangle may be used. FIG. 6C, shows an asymmetrical pentagon 28 with at least side 29A being of a different length. Other asymmetrical polygonal shapes can also be used. FIG. 6D shows the use of two dissimilar circles 30 A, B attached at their adjacent surfaces. As shown in FIG. 6E the circles 30 A, B may only be partial. In FIG. 6F, the use of dissimilar shapes, in this instance a rectangle 32 coupled to a circle 34 is used. In FIG. 6G, the use of dissimilar ovals 36 A, B are used. FIG. 6H simple knocks one corner 39 off a rectangle 37 to form a notch or key.

Figure 7A:
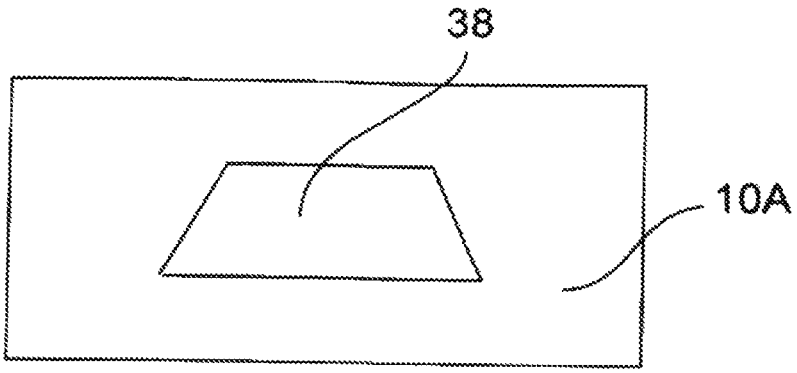
FIGS. 7A and B how another embodiment in planar bottom up view.
Figure 7B:
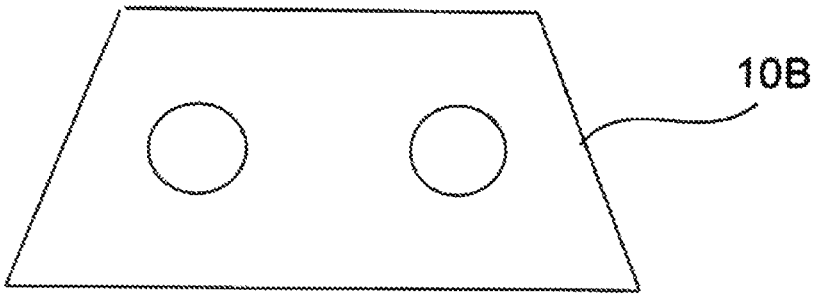

In some embodiments, as shown in FIG. 7A, it may be desirable to have a first plate portion 10A having a symmetrical outer shape that corresponds to the symmetrical shape of the opening 12 of the holder 4 (not shown) and an opening 38 of an asymmetrical shape such as any of those discussed above in the first plate portion 10A. A second plate portion 10B in FIG. 7B fits into the asymmetrical opening 38 of the first plate portion 10. In this manner a universal design can be made that allows for the orientation of the bag 2 in the plate 10 in the holder 4.

Figure 8:
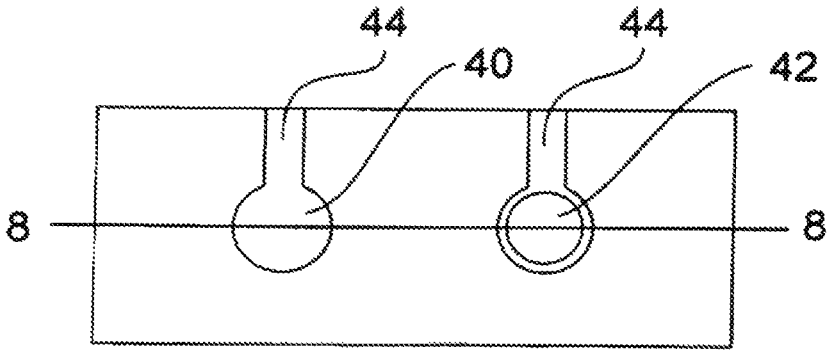
FIG. 8 shows a further embodiment in planar bottom up view.

As shown in FIG. 8 any of the plates 10 may also have a series of preformed holes 40 or holes containing knock out plugs 42 arranged in the most common positions in the plate 10 so that one plate may be used with a variety of bag/port designs. Additionally, channels 44 from the edge of the plate 10 to the holes 40 or knockout plugs 42 may be included with this or any other embodiment to allow one to squeeze the tubing adjacent the port(s) so as to allow one to fit the plate onto an existing bag.

Figure 9:
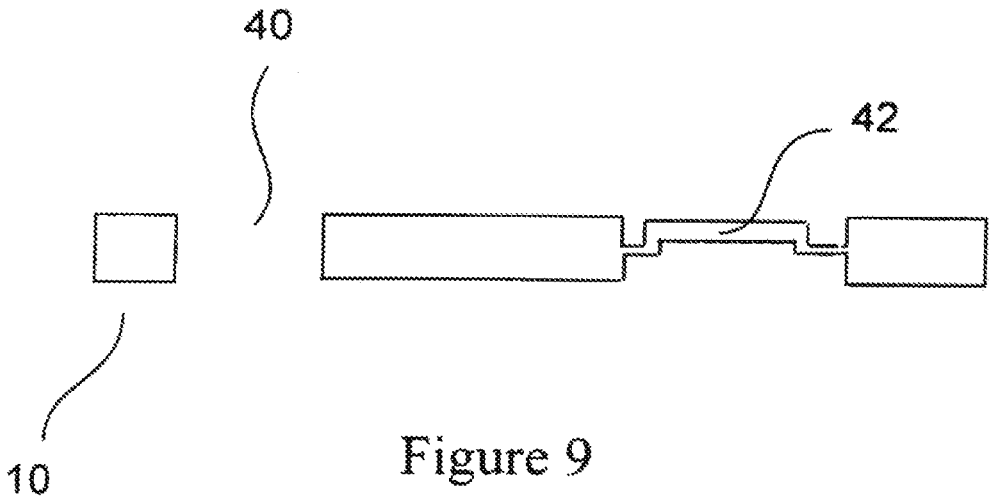
FIG. 9 shows a knockout plug according to an embodiment of the present invention in cross-sectional view.

FIG. 9 shows a cross-sectional view of knock out plug 42 in the plate 10 taken along lines 8-8.

The alignment plate can be made of various materials, such as plastic (thermoplastic or thermoset) composites (such as graphite composites or fiberglass composites), metal such as stainless steel or aluminum) or wood (such as pine, cedar or wood composites or plywood).

One preferred material is stainless steel in that even when relatively thin it is still strong, is well known and widely used in the industry and is compatible with the bags and holder.

Another is a thermoplastic such as polyethylene, polypropylene, PVDF, PES, and the like. One embodiment is to use a high density polyethylene. Another is a linear low density polyethyelene.

Thermosets such as urethanes or epoxies may be used to form the plate. Composites such as fiberglass or graphite composites are also useful.

Wood is relatively inexpensive and light weight and can be used in the present invention as well. Rot resistant woods such as cedar or various pines are useful. Plywood, chip board, wood laminates and the like are also useful, although they may need a protective coating if they are to be subjected to a wet environment.

In a further alternative embodiment of this invention, one can coat the steel, plastic or wood layer with a thermoplastic layer, a thermoelastomeric layer such as a thermoplastic elastomer (TPE) or an elastomeric layer such as a silicone layer. In one example of this embodiment, the rigid plate is made of steel, preferably stainless steel, which is coated on at least one side and preferably encapsulated in a plastic such as polyethylene or polypropylene, a TPE or a silicone. In another embodiment, the plate is made of a plastic to which silicone adheres such as polysulfones or polyethersulfones. In a further embodiment, the plastic plate can be coated or encapsulated or laminated with another plastic layer or TPE layer. In the same way, a wood plate can also be coated or encapsulated with one of these layers.

The coated layers may provide additional cleanliness to the plate or act as a bonding layer between the plate and the bag to which it is attached if such bonding is desired. It also reduces the potential for flash or rough surfaces on the plate to pierce the adjacent bag.

The plate may in the case of plastics, composites and metals either formed from a blank sheet of material or molded as the finished plate. Wood can be formed from a blank and shaped into the desired configuration and port arrangement.

Additionally, wireless tracking devices such as RFID chips, Zigbee® or Bluetooth devices may also be included on the plate to provide manufacturing data about the plate, the bag to which it is attached and with devices having read/write capabilities to track the use of the bag at the user's facility. There information relating to a trackable event such as entry into inventory, use, the material made or stored in the bag, etc can added by the user to the tag.

What is claimed:

1. A disposable processing bag formed of one or more pieces of plastic sealed to form a closed container, one or more ports formed in the bag to provide access to an interior of the bag for the introduction and/or removal of materials to the bag and an alignment plate attached to the bag adjacent the one or more ports, the plate has an outer edge that is asymmetrical shaped and corresponding to that of the opening of a corresponding holder, wherein the opening and the plate are both in the shape of a four-sided polygon having opposite first and second sides parallel to each other and a third and fourth sides converging relative to each other and intersecting the first and second sides at an angle of greater than 0 degree and less than 180 degree and the plate fits into and aligns with the opening in the holder in only one orientation for proper alignment of the bag within the holder.

2. The bag of claim 1, wherein the plate is attached to the one or more ports by one or more cable ties.

3. The bag of claim 1, wherein the plate is welded to surface of the bag adjacent the one or more ports.

4. The bag of claim 1 wherein the plate is molded to an adjacent surface of the bag.

5. The bag of claim 1, wherein the plate has one or more openings aligned to match the one or more ports of the bag and the plate is overmoided to an adjacent surface of the bag.

6. The bag of claim 1 further comprising a wireless device attached to the plate.

7. The bag of claim 1 further comprising a wireless device attached to the plate, wherein the wireless device is an RFID chip.

8. A disposable processing bag formed of one or more pieces of plastic sealed to form a closed container, one or more ports formed in a bottom of the bag to provide access to an interior of the bag for the introduction and/or removal of materials to the bag, and an alignment plate attached to the bag or to one or more ports of the hag, wherein the plate has one or more openings aligned to match the one or more ports, the plate has a uniquely shaped outer edge corresponding to the opening of a holder such that the plate fits. into and aligns with the opening in the holder in only one orientation for proper alignment of the bag within the holder.

9. The bag of claim 8, wherein the plate is attached to the one or more ports by one or more cable ties.

10. The bag of claim 8, wherein the plate is welded to surface of the bag adjacent the one or more ports.

11. The bag of claim 8, wherein the plate is molded to an adjacent surface of the bag.

12. The bag of claim 8, wherein the plate is overmolded to an adjacent surface of the bag.

13. The bag of claim 8, further comprising a wireless device attached to the plate.

14. The bag of claim 8, further comprising a wireless device attached to the plate, wherein the wireless device is an RFID chip.

* * * * *

UNITED STATES PATENT AND TRADEMARK OFFICE

CERTIFICATE OF CORRECTION

PATENT NO. : 9,272,840 B2
APPLICATION NO. : 14/745770
DATED : March 1, 2016
INVENTOR(S) : James Hobson et al.

It is certified that error appears in the above-identified patent and that said Letters Patent is hereby corrected as shown below:

Claims

In column 6, line 11, in claim 5 delete “overmoided” and insert -- overmolded --, therefor.

In column 6, line 22, in claim 8 delete “hag” and insert -- bag --, therefor.

In column 6, line 25, in claim 8 delete “fits. into” and insert -- fits into --, therefor.

Signed and Sealed this
Seventeenth Day of May, 2016

Michelle K. Lee

Michelle K. Lee
*Director of the United States Patent and Trademark Office*